US005826890A

United States Patent [19]

Swande

[11] Patent Number: 5,826,890

[45] Date of Patent: Oct. 27, 1998

[54] ICE SKATE BLADE

[75] Inventor: Jerker Swande, Stockholm, Sweden

[73] Assignee: Orebroskenan Aktiebolag, Orebro, Sweden

[21] Appl. No.: 646,335

[22] PCT Filed: Nov. 18, 1994

[86] PCT No.: PCT/SE94/01101

§ 371 Date: Jun. 3, 1996

§ 102(e) Date: Jun. 3, 1996

[87] PCT Pub. No.: WO95/15199

PCT Pub. Date: Jun. 8, 1995

[30] Foreign Application Priority Data

Dec. 3, 1993 [SE] Sweden ..... 9304036

[51] Int. Cl.[6] ..... A63C 1/34

[52] U.S. Cl. ..... 280/11.18

[58] Field of Search ..... 280/11.18, 11.12, 280/11.17, 28

[56] References Cited

U.S. PATENT DOCUMENTS

| | | | |
|---|---|---|---|
| 60,431 | 12/1866 | Scott et al. | 280/11.18 |
| 187,697 | 2/1877 | Adair | 280/11.18 |
| 286,199 | 10/1883 | Hindley | 280/11.18 |
| 524,129 | 8/1894 | Bryant | 280/11.18 |
| 1,100,976 | 6/1914 | Hille | 280/11.18 |
| 4,392,658 | 7/1983 | Redmond et al. | 280/11.18 |
| 4,907,813 | 3/1990 | Hall | 280/11.18 |

FOREIGN PATENT DOCUMENTS

| | | | |
|---|---|---|---|
| 094016782 | 8/1994 | Sweden | 280/11.18 |
| WO 82/00255 | 2/1982 | WIPO . | |

*Primary Examiner*—Brian L. Johnson
*Assistant Examiner*—Avraham Lerner
*Attorney, Agent, or Firm*—Sughrue, Mion, Zinn, Macpeak & Seas, PLLC

[57] ABSTRACT

An ice-skate blade includes a central main runner and side-runners positioned on opposite sides of the main runner. The blade includes three zones separated in the longitudinal direction of the blade, namely an essentially central glide zone 8, 9, having one or more runners located on the same level, and a rear zone and a front zone having side-runners which extend on respective sides of the main runner and which are located at a higher level than the main runner, so as to grip the ice only when the blade is tilted. The side-runners extend along the full length of the main runner.

21 Claims, 2 Drawing Sheets

ICE SKATE BLADE

BACKGROUND OF THE INVENTION

The present invention relates to an ice-skate blade which includes a central main runner and side-runners positioned on respective sides of the main runner.

A conventional ice skate has a continuous elongated blade. Depending on the use for which the ice skate is intended, the blade will have a different curvature in its longitudinal direction, so as to vary the surface along which it has contact with the ice. For instance, in the case of ice-skates that are intended for speed-skating, the blade is relatively long and generally straight so as to provide a long abutment surface with the ice and therewith will generate less friction. On the other hand, ice skates that are intended for ice-hockey players have a relatively pronounced curvature in their longitudinal direction, so as to shorten the ice contacting surface and enable the player to turn more effectively. This blade curvature may also vary between skates that are intended for defensive players and skates that are intended for attacking players, since the nature of the turns performed by such players place different requirements on the turning ability of the skates.

The blade is normally ground to an elongated hollow or cupped shape, such as to provide two ice-engaging edges and therewith provide the best possible engagement of the blade with the ice. The deeper the hollow, the better the grip obtained. This is achieved, however, at the cost of impaired sliding or skating action, since the edges cut deeper into the ice. This prevents the length over which the blade makes contact with the ice from being made too short, since the pressure at which the skate bears on the ice, and therewith the extent to which the blade cuts into the ice, will increase with shorter contact lengths.

U.S. Pat. No. 4,392,658 teaches an ice skate blade which includes a longitudinally extending main runner and side-runners placed on respective sides thereof. A common feature of all the blade configurations described in this specification is that the main runner and side-runners extend parallel with one another along the full length of the blade, such that coaction between the main runner and the side-runners is the same along the full length of the blade.

WO 82/00255 describes an ice skate which includes a main runner and side-runners positioned on respective sides of the main runner. These side-runners are located at a higher level than the cutting edge of the main runner along the whole of their length. The purpose of this is to improve the mechanical strength and the stability of the main runner, and also to reduce the load on the ankle. In this regard, it is also noted that under certain conditions, the side-runners provide a firmer grip on the ice.

In our earlier International Patent Application Publication No. WO94/1678, there is described an ice skate which includes a main runner and side-runners positioned on a respective side of the main runner, wherein the main runner is discontinuous so as to provide a front and a rear glide surface. In this case, the side-runners are located at a lower level than the main runner over a central part of the blade construction.

SUMMARY OF THE INVENTION

The main object of the present invention is to improve the gliding properties of an ice-skate blade while retaining or improving the ability with which turns can be made on the ice and also the engagement of the blade with the ice.

The invention is based on the concept that the aforesaid object can be achieved with the aid of a blade that has a central main runner and side-runners on respective sides of the main runner. The side-runners have a relatively deep hollow and are utilized to obtain a good grip with the ice when moving forward abruptly from a stationary position and when turning on the ice, which enables the main runner to have a relatively shallow hollow, therewith improving the gliding properties of the runner, in accordance with the aforegoing.

According to the invention, the side-runners take-over the function of the main runner when accelerating suddenly on the ice from a stationary position, and when turning and skid-stopping on the ice, therewith enabling the configuration of the main runner and the way that it is ground to be optimized so as to obtain the best gliding ability and turning ability on the ice. As evident from the foregoing, it is important to the gliding ability of the skate that the blade does not cut to an unnecessary depth in the ice, and that the length of blade in contact with the ice should be minimized to achieve the best turning ability. Both of these requirements are fulfilled in accordance with the invention.

An ice-skate blade constructed in accordance with the invention is mainly characterized in that the blade includes three longitudinally separated parts or zones, i.e. a generally central glide-part having one or more runners on mutually the same level, and a rear part and a front part having side-runners which extend on a respective side of the main runner, these side-runners being located at a higher level than the main runner so as to make contact with the ice only when the skate is inclined relative thereto.

A blade of this construction combines the advantage of a large abutment surface over a relatively short, central glide-part of the main runner with sharp runners which provide effective and sharp engagement with the ice and which have the form of side-runners along the front and the rear parts of the main runner.

According to one embodiment, the side-runners extend along the full length of the main runner, wherein the glide-part of the main runner is suitably longer than the glide-parts of the side-runners.

According to another embodiment, the width of the main runner over the central glide-part corresponds to the sum of the widths of the main runner and the two side-runners at the front and the rear parts of the blade respectively.

Preferably, the radius of curvature of the front and the rear parts of the side-runners will be smaller than the radius of curvature of the corresponding parts of the main runner, so as to further improve maneuverability.

According to one particularly preferred embodiment, the main runner and the side-runners are ground in a common blade. All runners are therewith hollow-ground and include two ice-engagement edges, wherein mutually adjacent runners have a common edge. The main runner is conveniently ground to a shallower hollow than the side-runners.

BRIEF DESCRIPTION OF THE DRAWINGS

The invention will now be described in more detail with reference to exemplifying embodiments thereof and also with reference to the accompanying drawings, in which.

DETAILED DESCRIPTION OF THE PREFERRED EMBODIMENTS

Figure 1:
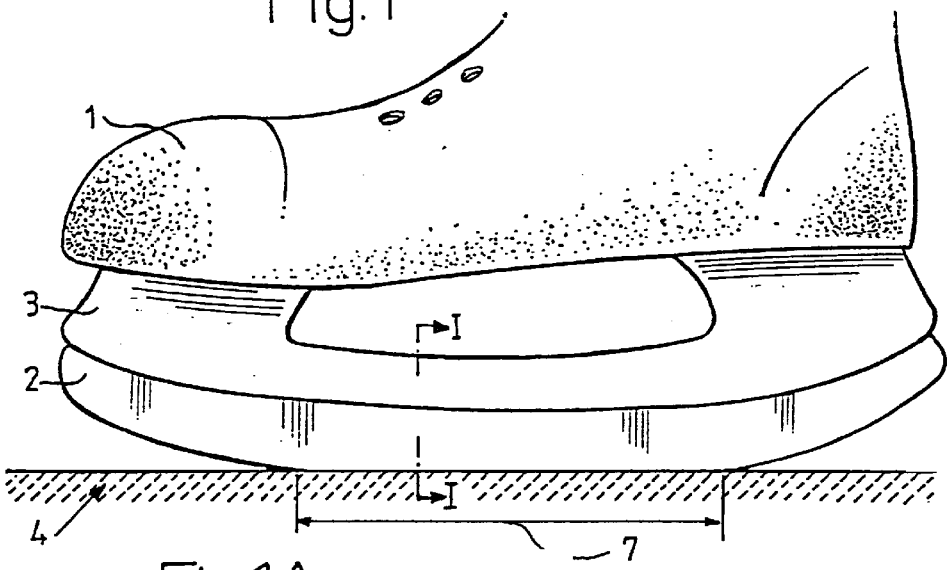
Fig.1 PRIOR ART
FIG. 1 illustrates a conventional ice-hockey skate.

FIG. 1 illustrates an ice-hockey skate 1 having a main blade 2 which is firmly mounted in a plastic body 3. The illustrated blade has a relatively long glide-part 7, which reduces the specific pressure on the ice 4, wherewith the gliding ability of the skate increases when skating forward with the blade in an upright position substantially perpendicular to the surface of the ice. The long glide-part has a negative influence on the maneuverability of the skate, however.

Figure 1A:
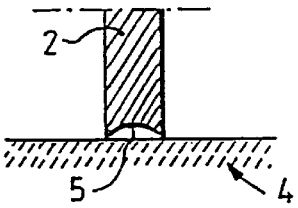
Fig.1A PRIOR ART
FIGS. 1A and 1B are respective enlarged sectional views taken on the line I—I in FIG. 1, with the skate vertical and tilted respectively.
Figure 1B:
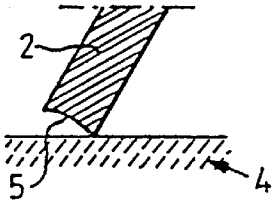
Fig.1B PRIOR ART

The illustrated main blade has been ground to a conventional hollow or cupped shape (see FIGS. 1A and 1B) so as to provide the requisite grip on the ice when making a fast, abrupt start from a standstill position, when making turns on the ice and when performing stop-skids. When the skate glides forwards in a straight line, the two edges of the runner will make contact with the ice, FIG. 1A, whereas when the skate is tilted only one or the other edge will make contact with the ice (FIG. 1B). It is necessary to adapt the extent of the hollow to the individual requirements of the person concerned, so as to achieve a balance between good engagement with the ice and good gliding ability of the skate. The deeper the hollow, the better the engagement of the blade with the ice, although at the cost of the ability of the blade to glide. The depth of the hollow must also be adapted to the weight of the player concerned and to the hardness of the ice.

As will be evident from the Figure, a conventional ice-hockey skate blade will be curved in its longitudinal direction in a manner to provide a relatively short ice-engagement surface, this curve being located generally centrally beneath the foot. The length of the ice-engagement surface is adapted to the requirements of the individual, wherewith a defensive player will normally desire a shorter engagement surface than an attacking player, so as to obtain better turning ability. However, the ice-engagement surface cannot be made too short, because the surface pressure would then become so great as to cause the blade to bite much too deeply into the ice.

Figure 2:
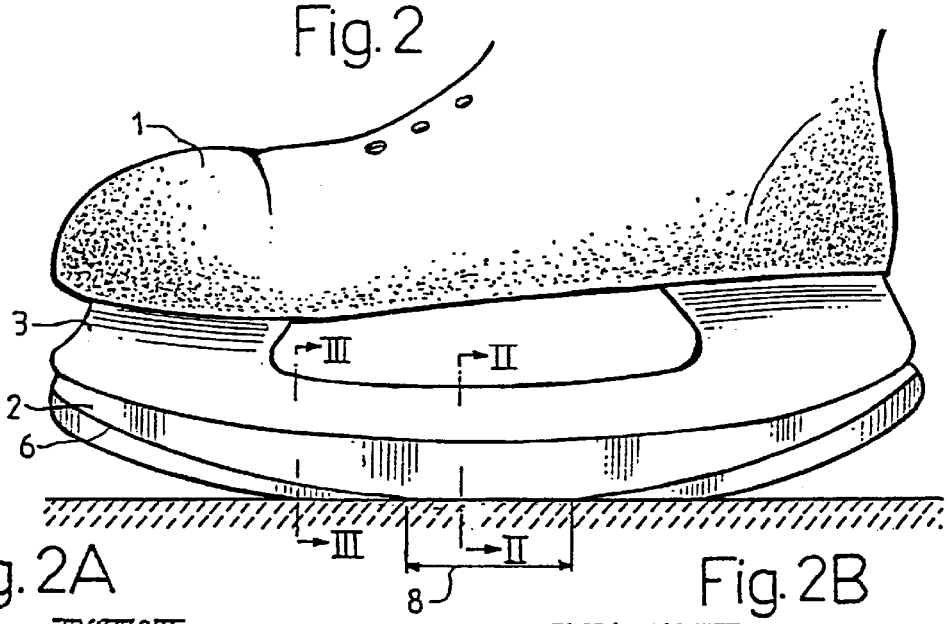
FIG. 2 illustrates an ice skate having a modified blade in accordance with the invention.

In the case of an inventive blade, see FIG. 2, which in addition to a main runner 5 also includes side-runners 6 extending on opposite sides of the main runner, the glide-part 8 can be made much shorter and therewith considerably improve maneuverability. This is made possible because the side-runners 6 are located on the same level as the main runner 5 over the glide-part 8, which is therewith given a larger surface area and accordingly improved supportability over this part of the blade, see FIG. 2A, despite the length of said part being relatively short.

Figure 2A:
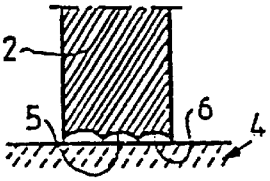
FIGS. 2A and 2B are enlarged sectional views taken on the line II—II in FIG. 2 and show respectively a vertical and a tilted blade.
Figure 2B:
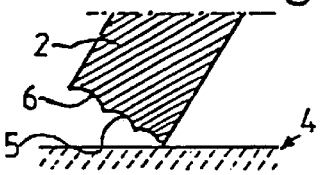

The gliding ability of the blade is also improved because the main runner 5 can have a relatively shallow hollow, as when the skate is tilted to one side, the relevant outer runner takes over contact with the ice 4, see FIG. 2B, therewith providing very effective ice-engagement.

The short glide surface and the engagement of respective side-runners with the ice when the blade is tilted provide for a highly effective turning ability while, at the same time, retaining the gliding ability of the blade as a result of the coaction between the side-runners and the main runner when skating forwards in a straight line.

By "glide-part" is meant the essentially straight part of the blade 2 which makes contact with the ice when the skate is upright and the skater skates forward in a straight line. In the case of the blade shown in FIG. 2, it is preferred that the glide-part of the main runner 5 is slightly longer than the glide-parts of the side-runners 6.

As an alternative to a main runner and two side-runners that have been ground in the manner illustrated in FIGS. 2A and 2B, the glide-part 8 of the blade 2 may have the form of a broader main runner having the same width as the sum of the widths of the main runner and the two side-runners at the front and the rear parts of the blade. The glide-part of the blade can therewith be ground to provide a shallow hollow or may alternatively be ground flat.

Figure 3A:
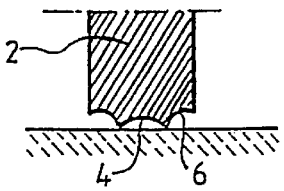
FIGS. 3A–3C are enlarged sectional views taken on the line III—III in FIG. 2 and show respectively a vertical blade and two different blade inclinations relative to the ice.
Figure 3B:
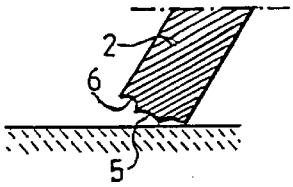
Figure 3C:
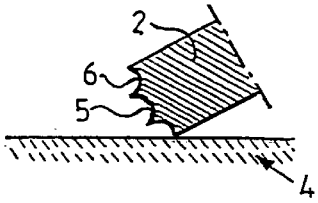

Particularly when making a fast start from a standstill position or when turning on the ice, the skater will normally angle his/her foot and leg so as to shift the ice-contact to the forward or the rearward parts of the blade. In order to provide the best effect in these situations, the side-runners 6 are located at a higher level than the main runner 5 over the front and the rear blade parts. In this regard, only the main runner 5 will make contact with the ice when skating forward in a straight line but with the ice-contact shifted from the central part of the blade, see FIG. 3A. When making a fast start from a stationary position or when turning on the ice the skate is angled and the two gripping edges of one side-runner 6 will engage the ice, see FIG. 3B. If the blade is tilted to a greater extent, the full engagement of the blade with the ice will be shifted to the outer gripping edge of the side-runner 6, see FIG. 3C. Highly effective engagement with the ice is achieved in this position.

Figure 4:
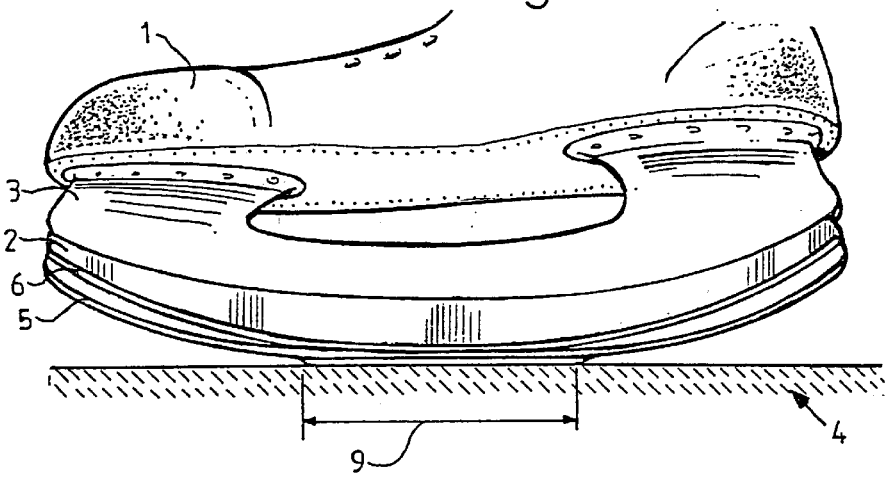
FIG. 4 is a view taken obliquely from beneath an ice skate fitted with an inventive blade, and shows the skate in the performance of a turn or a stop-skid.

As shown in FIG. 4, the main runner 5 and the side-runners 6 of the illustrated blade are located on the same level along a substantial part 9 of the glide-part of the main runner, whereas the side-runners 6 have a smaller radius of curvature than the main runner at those parts which lie forwardly and rearwardly of the glide-part respectively. In the braking position shown in the Figure, one outer runner of the blade will engage the ice, as illustrated in FIG. 2B.

Figure 5A:
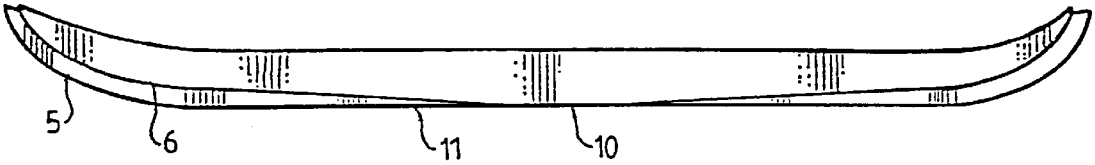
FIGS. 5A and 5B illustrate a separate inventive blade from one side and in perspective obliquely from beneath respectively.
Figure 5B:
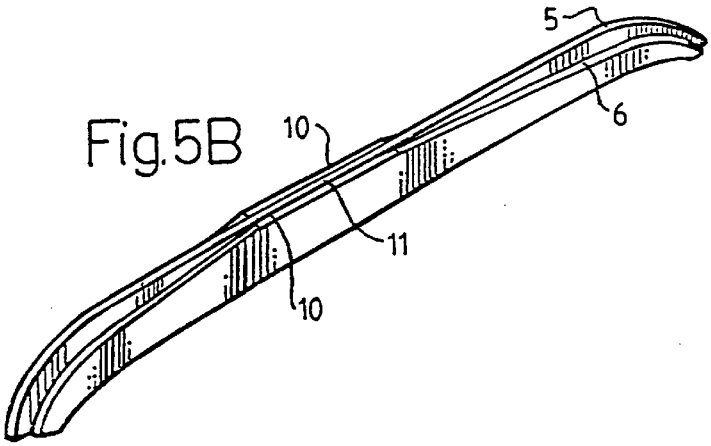

In the case of the blade shown in FIGS. 5A and 5B, the glide-parts of the side-runners 6 are referenced 10 and the longer glide-part of the main runner 5 is referenced 11.

For the sake of simplicity, none of the Figures show the blade sections biting into the surface of the ice, and the illustrated blade sections thus correspond to conditions that prevail when skating on very hard ice. However, the principles are the same even when skating on ice which is less firm and into which the edges of the runners will cut relatively deeply. The depth to which the hollows of respective runners are ground should thus be adapted to the quality of the ice concerned and also to the weight of the skater.

As illustrated, it is preferred that all runners are "facet-ground" in a steel blade which is common to all runners and which may be secured to the shoe in a conventional manner. The blades may also be exchangeable. It is also conceivable to construct a blade of several mutually joined thinner blades, each representing a runner. All runners are preferably hollow-ground, wherein the main runner will have a shallower hollow or cupped shape than the side-runners. The main runner may alternatively be ground flat, in order to improve gliding properties.

It will be understood that the inventive principles may also be applied with skates that are intended for purposes other than those mentioned, such as bandy, speed-skating and long-distance skating. The variations demanded by the special requirements placed on the blade with each separate application can be determined by the person skilled in this art and lie within the scope of the present invention.

I claim:

1. An ice-skate blade, comprising:

a) a single blade comprising a sharp-edged main runner (5) flanked by a pair of sharp-edged side-runners (6) disposed on opposite sides of the main runner, b) wherein:

i) the single blade defines in succession, in a longitudinal direction of the blade, a front zone, a central glide zone (8; 9), and a rear zone, ii) in the central glide zone the runners are disposed at substantially the same level, and iii) the side-runners in the front and rear zones are disposed at a higher level than the main runner, so as to grip the ice only when the blade is tilted.

2. A blade according to claim 1, wherein the side-runners extend along the full length of the main runner (5).

3. A blade according to claim 2, wherein a glide-length (11) of the main runner is longer than glide-length (10) of the side-runners (6).

4. A blade according to claim 1, wherein the central glide-zone of the main runner has a width which corresponds to the sum of the widths of the main runner and the two side-runners at the front and rear zones of the blade.

5. A blade according to claim 1, wherein said central glide zone extends over one third or less of the total longitudinal length of said blade.

6. An ice-skate blade, comprising:

a) a single blade comprising a main runner (5) flanked by a pair of side-runners (6) disposed on opposite sides of the main runner, b) wherein:

i) the single blade defines in succession, in a longitudinal direction of the blade, a front zone, a central glide zone (8; 9), and a rear zone, ii) in the central glide zone the runners are disposed at substantially the same level, iii) the side-runners in the front and rear zones are disposed at a higher level than the main runner, so as to grip the ice only when the blade is tilted, and iv) the side-runners forwardly of and rearwardly of the central glide-zone have a smaller radius of curvature in the longitudinal direction than corresponding parts of the main runner.

7. A blade according to claim 6, wherein the side-runners extend along the full length of the main runner (5).

8. A blade according to claim 7, wherein a glide-length (11) of the main runner is longer than glide-lengths (10) of the side-runners (6).

9. A blade according to claim 6, wherein the central glide-zone of the main runner has a width which corresponds to the sum of the widths of the main runner and the two side-runners at the front and rear zones of the blade.

10. A blade according to claim 6, wherein both the main runner and the side-runners are ground in a common blade (2).

11. A blade according to claim 10, wherein all runners are ground to a hollow or cupped configuration and each has two ice-gripping edges.

12. A blade according to claim 11, wherein juxtaposed runners have a common edge.

13. A blade according to claim 11, wherein the hollow ground in the main runner is shallower than the hollow ground in the side-runners.

14. An ice-skate blade, comprising:

a) a main runner (5) flanked by a pair of side-runners (6) disposed on opposite sides of the main runner, b) wherein:

i) the blade defines in succession, in a longitudinal direction of the blade, a front zone, a central glide zone (8; 9), and a rear zone, ii) in the central glide zone the runners are disposed at substantially the same level, iii) the side-runners in the front and rear zones are disposed at a hither level than the main runner, so as to grip the ice only when the blade is tilted, and iv) wherein both the main runner and the side-runners are ground in a common blade (2).

15. A blade according to claim 14, wherein all runners are ground to a hollow or cupped configuration and each has two ice-gripping edges.

16. A blade according to claim 15, wherein juxtaposed runners have a common edge.

17. A blade according to claim 15, wherein in that the hollow ground in the main runner is shallower than the hollow ground in the side-runners.

18. A blade according to claim 14, wherein the side-runners extend along the full length of the main runner (5).

19. A blade according to claim 18, wherein a glide-length (11) of the main runner is longer than glide-lengths (10) of the side-runners (6).

20. A blade according to claim 14, wherein the central glide-zone of the main runner has a width which corresponds to the sum of the widths of the main runner and the two side-runners at the front and rear zones of the blade.

21. A blade according to claim 14, wherein the side-runners forwardly of and rearwardly of the central glide-zone have a smaller radius of curvature in the longitudinal direction than corresponding parts of the main runner.

* * * * *